US005110016A

United States Patent [19]

Heimann et al.

[11] Patent Number: 5,110,016

[45] Date of Patent: May 5, 1992

[54] CARAFE AND THE METHOD OF MAKING

[75] Inventors: Gisbert Heimann; Walter Kramer, both of Mainz, Fed. Rep. of Germany

[73] Assignee: Schott Glaswerke, Mainz, Fed. Rep. of Germany

[21] Appl. No.: 565,846

[22] Filed: Aug. 13, 1990

[30] Foreign Application Priority Data

Aug. 12, 1989 [DE] Fed. Rep. of Germany ..... 3926760

[51] Int. Cl.[5] ..... A47G 19/14

[52] U.S. Cl. ..... 222/475.1; 215/100 A; 16/110.5

[58] Field of Search ..... 222/465.1; 215/100 A; 16/110.5

[56] References Cited

U.S. PATENT DOCUMENTS

| | | | |
|---|---|---|---|
| 2,807,944 | 10/1957 | Glass | 65/31 |
| 4,683,155 | 7/1987 | Majthan | 222/465.1 X |
| 4,838,463 | 6/1989 | Roberts | 222/465.1 |

FOREIGN PATENT DOCUMENTS

| | | |
|---|---|---|
| 7131692 | 11/1971 | Fed. Rep. of Germany . |
| 3048783A1 | 7/1982 | Fed. Rep. of Germany . |
| 3246184 | 6/1983 | Fed. Rep. of Germany . |
| 3220057 | 12/1983 | Fed. Rep. of Germany . |
| 3713685 | 11/1988 | Fed. Rep. of Germany . |
| 3717772A1 | 11/1988 | Fed. Rep. of Germany . |
| 1328388 | 4/1962 | France . |
| 1529141 | 10/1978 | United Kingdom . |
| 83/00424 | 2/1983 | World Int. Prop. O. . |

*Primary Examiner*—Kevin P. Shaver
*Assistant Examiner*—Gregory L. Huson
*Attorney, Agent, or Firm*—Millen, White & Zelano

[57] ABSTRACT

A carafe made of completely non-metallic parts includes a glass body portion with rim. A plastic edge member is fitted over the rim and secured by adhesive. The plastic edge member has a notch therein which received a projection from a plastic handle which is bonded to the outside surface of the glass body portion.

12 Claims, 1 Drawing Sheet

CARAFE AND THE METHOD OF MAKING

BACKGROUND OF THE INVENTION

This invention relates to a carafe and a process for production of the carafe.

Carafes, especially those made of glass that are used as serving and holding containers for coffee, for example, are provided with a plastic lip edge to reduce susceptibility to breakage when bumping against other objects. Such carafes are widely used especially in the restaurant and hotel business. The advantage of such carafes are the already mentioned limited susceptibility to breakage and more favorable pouring qualities that can achievable the plastic lip edge.

The quality requirements of such carafes are especially high for commercial use. Despite this, to remain competitive, the production costs must remain low. To meet these requirements, known carafes have a more or less raised glass neck on which the plastic edge,—usually of the bayonet type,—is jammed. The plastic edge can be further secured by sealing rings and/or adhesive between the plastic edge and the glass edge. The carrying handle of the carafe is connected to the plastic edge integrally or in several parts. The integral connection is preferred here since it is inexpensive. Carafes of this design are described in U.S. Pat. No. 3,632,025, 4,090,648 and 4,140,251 and in DE-OS 31 31 724.

In carafes of the type described, a long and precisely manufactured carafe neck is necessary to securely anchor the plastic edge. But this increases the production costs. The adhesive bond between the plastic edge and the glass edge has also proven problematic, because the adhesive bond is not flexible enough and in use, especially due to washing, tends to become brittle. In addition, the junction point must absorb the entire stress during handling when the carafe is full. The sum of these stresses has often led to damage as a result of the loosening of junction point.

SUMMARY OF THE INVENTION

The object of the invention is to make available a carafe, in particular made of glass, ceramics, glass ceramics, porcelain or other fragile material, with a plastic edge acting as a lip and a handle, with the production costs of the carafe being low and the production simple. Furthermore, it is an object of this invention to make fastening of the plastic edge simple and durable.

It has turned out that the fastening, known from the prior art, of the handle to the plastic edge can indeed be simple and inexpensive with respect to assembly and assembly costs, however that a handle attached to the outside of the carafe, separate from the plastic edge, has other advantages. The separation of plastic edge and handle as well as their fastening points, makes it possible to use different materials for each part and consequently to use different fastening means.

Thus the plastic edge, according to the prior art, can be made, e.g., of polypropylene and be connected to the glass edge by polyamide hot melt adhesive. At the same time, a bayonet locking can lead additionally to a positive locking between the plastic edge and carafe edge. These connections still have only essentially a sealing function, the mechanical load factor being very low. For this reason, depending on the embodiment of the plastic edge, the carafe edge can be manufactured with higher tolerances and thus more inexpensively, or the plastic edge can be fastened with a different adhesive, e.g., a medium-viscosity silicone adhesive, from that required in the prior art. Thus it is now possible to fasten or secure the plastic edge by a flexible adhesive that is stable as it ages but is thus less stressable mechanically.

According to the invention, the handle can now be produced of a plastic that is better suited, e.g., for bonding with the material of the carafe, e.g., glass, than the plastic edge that comes in contact with the (hot) beverage and that is preferably made of polypropylene. This can be done, e.g., with a handle made of ABS (acrylonitrile-butadiene-styrene copolymer) or PC (polycarbonate) by a permanently flexible silicone adhesive. Since these high-strength silicone adhesives are usually highly viscous, they are unsuited for fastening the plastic edge. Such a compound fulfills all necessary conditions of use with respect to resistance to cyclic temperature stress, resistance to being torn away and being dishwasher-proof. The handle can also be fastened to the outside of the carafe body by a metal band placed around the carafe or in another known way instead, as previously, to the lip edge and thus to the carafe neck. But fastening the handle with adhesive is the most advantageous type of fastening, since it is inexpensive. Such an approach utilizes no metal parts at all, making it microwave-safe.

There is also the possibility of configuring the handle so tat an upper part of the handle is engaged in the plastic edge. In this way, the plastic edge is secured on the edge of the glass carafe by positive locking with the handle.

There is further the possibility of equipping the carafe with an associated cover in all the usual forms. The cover can be set on unfastened, be snapped on the plastic edge and be integrated in the handle as a pivoting cover, etc.

The plastic edge acting as a lip can easily be produced in all desired embodiments—thus, e.g., with a molded-on lip. Here, materials other than polypropylene can be used, such as other plastics suitable for contact with food and sufficiently rigid while being heat-resistant. Especially when secured by the handle, the plastic edge can be fastened to the carafe edge by merely snapping the elastic edge on. For this purpose, the carafe edge is suitably made toroidally thicker so that it can snap on a corresponding recess on the plastic edge. Both parts are positively locked with one another by bayonet locking. The plastic edge is suitably configured so that the upper edge of the carafe engages in a ring-shaped depression on the plastic edge, and the inner wall of the ring-shaped depression is braced flexibly on the inside of the upper glass edge so that no liquid can get between the plastic edge and the upper carafe edge. Suitably, the outer wall of the ring-shaped depression also sits tightly on the outside of the carafe so that dishwater cannot get into the hollow space.

But preferably the plastic edge is fastened, as described, with a hot melt adhesive, preferably polyamide, to the upper carafe edge, and the described positive locking can be used for additionally securing both parts. The hot melt adhesive suitably at least mostly fills the hollow space between plastic edge and upper carafe edge so that no liquid can penetrate there.

A secure and liquid-tight connection between the plastic edge and carafe is easily possible in all cases since the connection—in contrast to the prior art—is relieved of the weight of the carafe.

Preferably the carafe is made of glass, since glass is an inexpensive and hygienic raw material. For special purposes, the carafe as well as the handel can be made of glass ceramics, ceramics, earthenware or porcelain, and then adhesives matched to the materials are used.

An embodiment of the invention is represented in the drawings and is described below in more detail.

DETAILED DESCRIPTION

Figure 1:
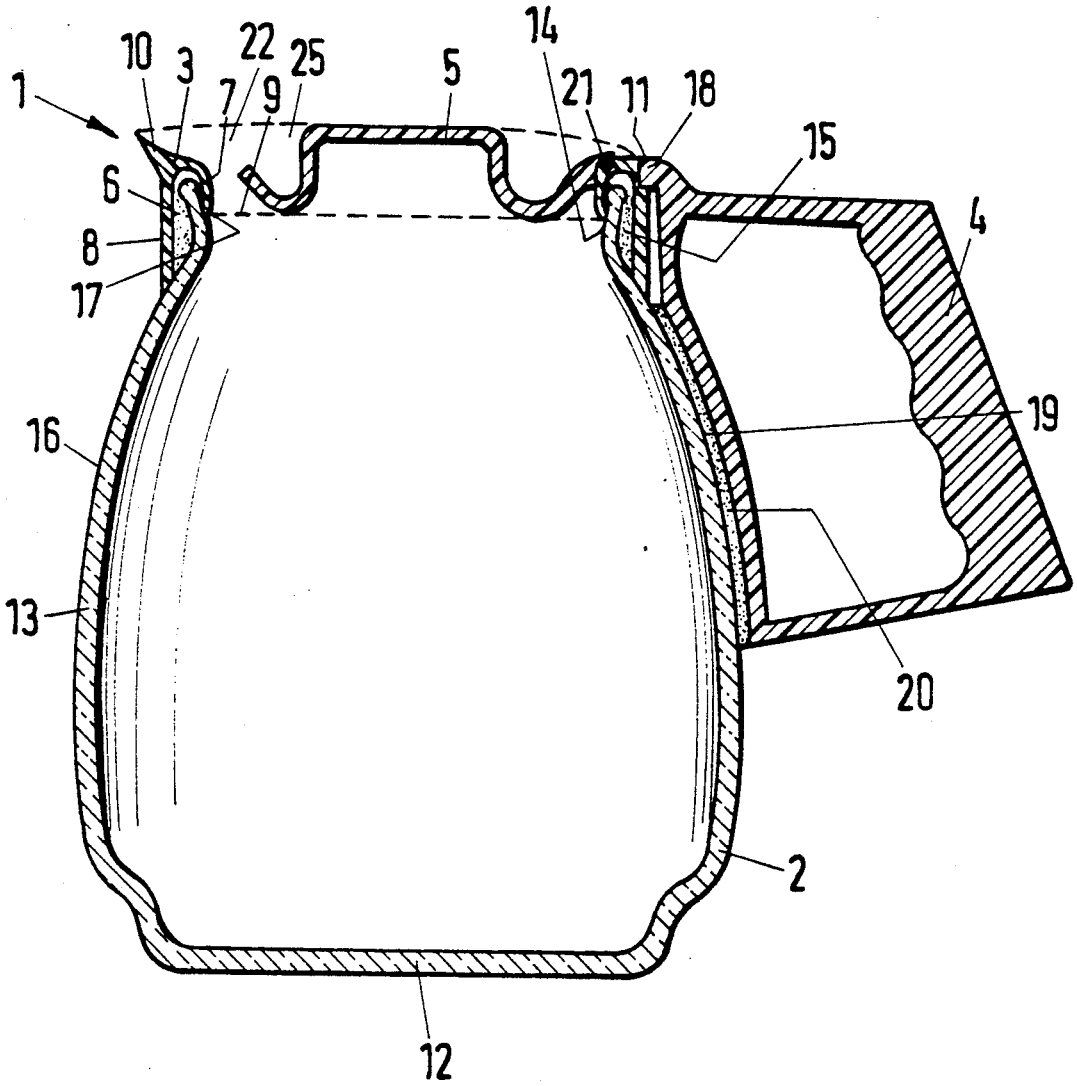
FIG. 1, a cross section through a carafe according to the invention made of glass with plastic edge and handle bonded thereto.

FIG. 1 shows a carafe 1 according to the invention with a glass container 2, a plastic edge 3 acting as a lip, a handle 4 and a cover 5. Plastic edge 3 is a ring-shaped and consists of a relatively rigid plastic, such as, e.g., polypropylene. A ring-shaped depression 6 is made in plastic edge 3 so that a short inner wall or flange 7 and a longer outer wall or flange 8 are formed. Lower end 9 of inner wall 7 thins out and is flexible. Ring-shaped plastic edge 3 exhibits a lip spout 10 and a notch 11 lying opposite one another.

Glass container 2 has a bottom 12 suitable for placement on a hot plate (not shown), an arc-shaped side wall 13 running upward and an edge or rim 14 slightly inclined outward, and entire glass container 2 is rotationally symmetrical.

When the carafe is assembled, the ring-shaped depression 6 is partially filled with to melt adhesive 15, preferably a polyamide hot melt adhesive, and is pressed on edge 14 of glass container 2 until outer wall 8 of plastic edge 3 is braced on outside 16 of glass container 2. In doing so, thinning inner wall 7 comes in contact with inside 17 of edge 14, so that a relatively smooth transition is produced between glass container 2 and plastic edge 3. The amount of hot melt adhesive 15 is measured advantageously so that the hollow space produced when ring-shaped depression 6 and edge 14 are together is at least mostly filled with hot melt adhesive 15.

After emplacement of plastic edge 3, notch 11 forms an auxiliary attachment for handle 4, so that the latter can be fastened without great expense exactly opposite lip 10 and at the current height on outside 16 of glass container 2. For this purpose, handle 4 includes a projection 18 that fits in notch 11 and is coated on its contact surface 19 facing glass container 2 with a permanently flexible silicone adhesive 20. After putting handle 4 and glass container 2 together, projection 18 positively locks and secures of plastic edge 3. Silicone adhesive 20 forms a bond between glass container 2 and handle 4 that is suited also for use in the hotel and restaurant business and that is resistant to cyclic temperature stress, tearing away as well as being dishwasher-proof.

Cover 5 can be permanently set in plastic edge 3 by pins 21, and a recess 22 permits the pouring of a beverage with which glass container 2 is filled.

Figure 2:
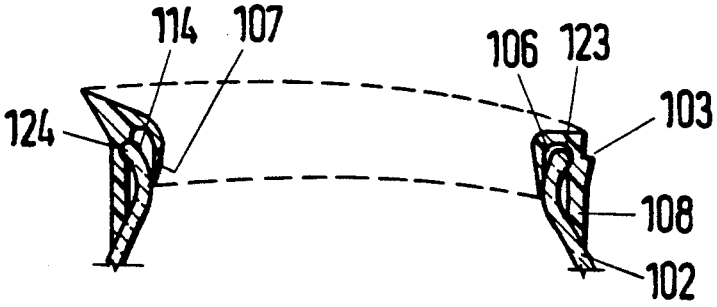
FIG. 2, is a cross section illustrating the upper edge of a carafe with plastic edge having a bayonet fastening.

FIG. 2 represents another possibility for a fastening between glass container 102 and plastic edge 103. Unlike plastic edge 3, outer wall 108 exhibits, in ring-shaped depression 106, a recess 123 going around it in which the end of edge 114 can snap. For this purpose, the end of edge 114 preferably exhibits a bulge 124. A recess 123 is made in the ring-shaped depression 106 so that, when bulge 124 snaps on, simultaneously the lower end of outer wall 108 and the thinning end of inner wall 107, as described in FIG. 1, come in contact with glass container 102. The somewhat flexible plastic of plastic edge 103 seals here on the glass of glass container 102.

Ring-shaped depression 106 can, as described in FIG. 1, also be filled with an adhesive. This adhesive increases the reliability of the plastic edge 103/glass container 102 bond and simultaneously reliably prevents a possible penetration of liquid into the hollow space formed between ring-shaped depression 106 and edge 114.

Different variations of the carafe according to the invention are possible. Thus glass container 2, 102 can have, e.g., an essentially cylindrical side wall 13, and the plastic edge 3 can be made without the inner wall 7 or outer wall 8. The plastic edge 3 then sits directly on the end of edge 14. The wall 25 of plastic edge 3 can be made in may ways, e.g., very steep and relatively long in the area of lip 10, but is common to all these variations that handle 4 is fastened to side wall 13 and not to edge 14 on glass container 2, so that the fastening of plastic edge 3 is not loaded with the entire weight of carafe 1.

Other fastenings of handle 4 are also possible, thus the handle can be fastened, e.g., by a metal band going around the body of the glass container. It is also possible to bond a base plate to the glass container and to mount the handle on this base plate.

We claim:

1. A carafe of non-metallic components comprising:

a unitary glass body portion having a side wall of a first diameter, a bottom and an opening of a diameter less than that of the sidewall defined by a rim having inner and outer surfaces to form a neck;

a plastic edge having a pouring lip at one location and handle attaching means positioned in opposed relation to the pouring lip; the plastic edge further including an inner flange which is positioned over the inner surface of the rim and an outer flange positioned over the outer surface of the rim with an annular space between at least the outer flange and outer surface, wherein the outer flange terminates in contact with the body portion at a location below the neck and the inner flange terminates within the neck, the inner flange being bevelled to provide a non-abrupt transition between the inner surface of the rim and plastic edge;

a layer of adhesive disposed in the annular space and bonding the plastic edge member to the rim, and a handle, the handle extending along and bonded to the side wall of the carafe at a location opposite the pouring lip of the plastic edge, the handle having means for positively cooperating with the handle attaching means of the plastic edge.

2. The carafe of claim 1, wherein the handle attaching means is a notch in the plastic edge member and the means on the handle for positively cooperating with the handle attaching means is a projection received within the notch.

3. The carafe of claim 1, wherein the rim includes an edge bead and wherein the plastic edge member has a resilient interface fit with the bead to mechanically secure the plastic edge member to the rim.

4. The carafe of claim 1 wherein the handle is bonded to the side wall by a layer of adhesive.

5. The carafe of claim 1, wherein the plastic edge is made of a relatively rigid plastic.

6. The carafe of claim 5, wherein the relatively rigid plastic is polypropylene.

7. The carafe of claim 6, wherein the layer of adhesive is formed of a hot melt adhesive material.

8. The carafe of claim 7, wherein the hot melt adhesive material is a polyamide hot melt adhesive.

9. The carafe of claim 1, wherein the handle is bonded to the side wall by a layer of adhesive which is of a different adhesive material then the layer of adhesive bonding the plastic edge member to the rim.

10. The carafe of claim 9, wherein the handle is bonded by a layer of a first flexible adhesive material and the plastic edge member is bonded by a layer of a second flexible adhesive material.

11. The carafe of claim 10, wherein the first flexible adhesive material is a permanently flexible silicone adhesive and the layer of second adhesive material is hot melt polyamide.

12. The carafe of claim 11, wherein the plastic edge member is made from polypropylene and the handle from a material selected from the group consisting of acrylonitrile-butadiene-styrene copolymer and polycarbonate.

* * * * *